United States Patent [19]

Schetelich et al.

[11] Patent Number: 4,502,970

[45] Date of Patent: Mar. 5, 1985

[54] LUBRICATING OIL COMPOSITION

[75] Inventors: Alan A. Schetelich, Scotch Plains; Norman Tunkel, Perth Amboy; Darrell W. Brownawell, Scotch Plains, all of N.J.

[73] Assignee: Exxon Research & Engineering Co., Florham Park, N.J.

[21] Appl. No.: 493,942

[22] Filed: May 12, 1983

Related U.S. Application Data

[63] Continuation-in-part of Ser. No. 386,293, Jun. 8, 1982, abandoned.

[51] Int. Cl.[3] ..... C10M 1/48

[52] U.S. Cl. ..... 252/32.7 E; 252/51.5 A; 252/33.4; 252/48.4; 252/52 R; 252/49.6

[58] Field of Search ..... 252/32.7 E, 49.6, 51.5 A, 252/33.4, 48.4, 52 R

[56] References Cited

U.S. PATENT DOCUMENTS

| | | | |
|---|---|---|---|
| 3,271,310 | 9/1966 | Le Suer | 252/35 |
| 3,288,714 | 11/1966 | Osuch | 252/32.7 E |
| 3,489,682 | 1/1970 | Le Suer | 252/32.7 E |
| 3,714,042 | 1/1973 | Greenough | 252/33.2 |
| 4,173,540 | 11/1979 | Lonstrup et al. | 252/49.6 |

*Primary Examiner*—Jacqueline V. Howard

*Attorney, Agent, or Firm*—John J. Mahon

[57] ABSTRACT

There is disclosed an improved lubricating oil composition useful in both gasoline and diesel engines which contains polyisobutenyl succinic anhydride as a supplemental dispersant-detergent in combination with a conventional lubricating oil dispersant.

9 Claims, No Drawings

LUBRICATING OIL COMPOSITION

CROSS REFERENCE TO RELATED APPLICATIONS

This application is a continuation-in-part of application Ser. No. 386,293, filed June 8, 1982 now abandoned.

This invention relates to an improved lubricating oil composition which is particularly useful both as a gasoline lubricant and as a diesel or compression ignition engine lubricant. More particularly, this invention relates to a finished lubricant formulation exhibiting improved performance in terms of dispersancy and detergency characterized by the use of certain amounts of polyisobutenyl succinic anhydride.

The present invention is based upon the use of polyisobutenyl succinic anhydride and prior art disclosures dealing with this material in various forms, including derivatives thereof, in engine lubricating oils include U.S. Pat. No. 3,271,310, which discloses metal salts of hydrocarbon substituted succinic anhydrides, especially polyisobutenyl succinic anhydrides, the salts being useful as detergent and rust inhibitors in lubricating oils. U.S. Pat. No. 3,714,042 discloses the preparation of novel compositions of matter by treating an overbased metal sulfonate, sulfonate-carboxylate or carboxylate complex with up to an amount equivalent to the basicity thereof, usually 1 to 10 weight percent, of a high molecular weight aliphatic carboxylic acid or anhydride, including the polyisobutenyl succinic anhydrides. This novel composition is said to offer less foaming and haze forming tendencies than the untreated metal complex. Also pertinent is U.S. Pat. No. 3,288,714, which discloses alkenyl succinic anhydrides of molecular weight 900 to 2,000 said to be suitable, per se, as ashless detergents or dispersants, especially as replacements for metal-containing detergents in gasoline engine formulations.

The present invention is based upon the discovery that the incorporation of certain amounts of polyisobutenyl succinic anhydride into a lubricating oil composition as a supplemental dispersant-detergent provides substantial improvements which are not obtainable even with equivalent amounts of conventional dispersants, such as the polyisobutenyl succinic anhydride-polyamine reaction products and borated derivatives thereof, which heretofore have been considered to be more effective than hydrocarbon substituted succinic anhydride. The amount of polyisobutenyl succinic anhydride is in excess of that recommmended by the foregoing references and, contrary to the teachings of the art, no reaction with sulfonate overbased complexes has been observed in the compositions of the present invention.

In accordance with the present invention, there has been discovered an improved crankcase lubricating oil composition effective in both gasoline and diesel internal combustion engines comprising a major amount of an oil of lubricating viscosity containing 0–15 wt. % of a viscosity index improver and (a) at least about 0.5 wt.% of lubricating oil dispersant;

(b) about 2 to 12 wt. % of an overbased metal detergent additive or mixtures thereof with neutral metal detergent additives, said metal detergent additives being selected from the group consisting of oil soluble calcium, magnesium and barium sulfonates, phenates and sulfurized phenates; and (c) a zinc dialkyl dithiophosphate anti-wear additive; and (e) a polyisobutenyl succinic anhydride having an $\overline{M}n$ (number average) molecular weight of about 900 to 2,000.

wherein the weight ratio of said dispersant to said polyisobutenyl succinic anhydride is less than 1.75 when the amount of said dispersant in the composition is 3.5 wt. % or wt. % or less and said weight ratio being less than about 7 when the amount of dispersant is greater than about 3.5 wt% up to about 10 wt. %.

It has been found that using the amounts of polyisobutenyl succinic anhydride together with dispersant in the ratios indicated provide a lubricating oil composition exhibiting greatly improved engine deposit control and varnish inhibition.

While the lubricating oil compositions of this invention are used preferably as crankcase lubricants for diesel engines, the oils will also qualify as gasoline engine crankcase lubricants under current standards for such lubricants. Thus, the compositions of the present invention achieve, through the use of the combination of dispersant and polyisobutenyl succinic anhydride, the highly desirable objective of providing a finished lubricating oil satisfying the relevant qualification tests and standards for both diesel and gasoline engine lubricating oil compositions for control and inhibition of deposits, sludge and varnish.

The amount of metal detergent additives may vary somewhat over the range indicated, these additives being an essential component of diesel lubricating oil compositions. It is important to note that the presence of polyisobutenyl succinic anhydride in the compositions of the present invention does not result in any reaction with sulfonates present as is disclosed in said U.S. Pat. No. 3,714,042, but to prevent any such reaction blending of materials should be conducted in a substantially water-free environment, i.e. less than about 1% by weight water. The amounts of polyisobutenyl succinic anhydride employed in the compositions of this invention are substantially in excess of the amounts recommended by said U.S. Pat. No. 3,714,042.

The use of a viscosity index improver is a noncritical aspect of this invention and for that reason the use of 0 to 15 weight percent viscosity index improver is set forth as indicating that the invention applies to both straight grade and multi-grade oils. The formulator simply employs whatever viscosity modifier is appropriate to provide the desired viscosity grade of lubricating oil. The essential aspect of this invention is that the lubricating oil contain the dispersant, metal detergent additive, zinc anti-wear additive and the polyisobutenyl succinic anhydride in the amounts indicated. There will usually be present other special purpose additives in customary effective amounts to provide their normal attendant functions, such as an anti-oxidant and anti-rust additive.

The finished lubricating oil prepared as described above will preferably contain the following active ingredient percentages by weight: 0.7–3 percent by weight of the dispersant, 3–6 weight percent of metal detergent additive or mixtures of said additives, 1–3 weight percent of zinc dihydrocarbyl dithiophosphate anti-wear additive and at least 2.5 up to about 5 weight percent of polyisobutenyl succinic anhydride. There will also be present in a finished oil small but effective amounts of other special purpose additives and these include anti-oxidants, anti-foamants, fuel economy or friction reducing additives and rust inhibitors. These are additives whose functions are not directed to provide improvements in detergency and dispersancy.

Optimum results have been obtained by incorporating polyisobutenyl succinic anhydride at a concentration of 3–4 wt% in the finished oil together with dispersant at the 0.7 to 3 wt% level. More broadly speaking it is considered feasible to raise the anhydride concentration as high as 15 wt% but there should be present, relative to the quantity of anhydride, about 20 wt% of dispersant.

The advantage of the present invention is reflected in test data relevant to both diesel and gasoline engine formulations. The results obtained show an overall improvement in deposit sludge and varnish control which has not been obtainable with equivalent amounts of conventional nitrogen-containing dispersants. These results are viewed as unexpected and surprising since polyisobutenyl succinic anhydride, per se, when used alone in the absence of a conventional dispersant will not provide satisfactory control of sludge and varnish in a lubricating oil formulation to the extent required to pass the critical diesel and gasoline engine qualification tests, which are required in order for a lubricant to qualify for the various service classification ratings, such ratings being essential in order to market a commercially acceptable lubricating oil composition.

The preferred polyisobutenyl succinic anhydride for use in the present invention is one having a number average molecular weight of about 1,300 and a saponification number of about 103. While a polyisobutenyl succinic anhydride of $\overline{Mn}=900$ is within the scope of this invention, the improvement noted, while significant, is not as substantial as the use of $\overline{Mn}=1300$ material which provides optimum performance at a given treatment level. However, the anhydride compound offers a clear cost advantage over an equivalent amount of conventional nitrogen-containing dispersant.

The preferred dispersants are the polyalkenyl succinimide or borated polyalkenyl succinimide dispersants where the alkenyl group of the succinic acid or anhydride is derived from a polymer of a $C_3$ or $C_4$ monoolefin, especially a polyisobutylene wherein the polyisobutenyl group has a number average molecular weight ($\overline{Mn}$) of about 700 to about 5,000, more preferably about 900 to 2,000. Particularly preferred are the polyisobutenyl succinimides, borated or non-borated, within the aforesaid molecular weight weight range.

Suitable polyamines for reaction with the aforesaid succinic acids or anhydrides to provide the succinimide are those polyalkyleneamines represented by the formula $$NH_2(CH_2)_n—(NH(CH_2)_n)_m—NH_2$$

wherein n is 2 to 3 and m is 0 to 10. Illustrative are ethylene diamine, diethylene triamine, triethylene tetramine, tetraethylene pentamine, which is preferred, tetrapropylene pentamine, pentaethylene hexamine and the like, as well as the commercially available mixtures of such polyamines. The amines are reacted with the alkenyl succinic acid or anhydride in conventional ratios of about 1:1 to 10:1 moles of alkenyl succinic acid or anhydride to polyamine, and preferably in a ratio of about 2:1.

The borated alkenyl succinimide dispersants are also well known in the art as disclosed in U.S. Pat. No. 3,254,025. These derivatives are provided by treating the alkenyl succinimide with a boron compound selected from the group consisting of boron oxides, boron halides, boron acids and esters thereof, in an amount to provide from about 0.1 atomic proportion of boron to about 10 atomic proportions of boron for each atomic proportion of nitrogen in the dispersant. The borated product will generally contain 0.1 to 2.0, preferably 0.2 to 0.8, weight percent boron based upon the total weight of the borated dispersant. Boron is considered to be present as dehydrated boric acid polymers attaching as the metaborate salt of the imide. The boration reation is readily carried out adding from about 1 to 3 weight percent based on the weight of dispersant, of said boron compound, preferably boric acid, to the dispersant as a slurry in mineral oil and heating with stirring from about 135° C. to about 165° C. for about 1 to 5 hours followed by nitrogen stripping and filtration of the product.

Besides the preferred category of dispersants noted above, the invention is applicable generally to those materials categorized as sludge dispersants for crankcase lubricating oil composition and their performance is markedly improved when they are used in combination with the polyisobutenyl succinic anhydride in accordance with this invention. Thses lubricating oil dispersants include mineral oil-soluble salts, amides, imides, oxazolines and esters of mono- and dicarboxylic acids (and where they exist the corresponding acid anhydrides) of various amines and nitrogen containing materials having amino nitrogen or heterocyclic nitrogen and at least one amido or hydroxy group capable of salt, amide, imide, oxazoline or ester formation. Other nitrogen containing dispersants which may be used in this invention include those wherein a nitrogen-containing polyamine is attached directly to the long chain aliphatic hydrocarbon as shown in U.S. Pat. Nos. 3,275,554 and 3,565,804 where the halogen group on the halogenated hydrocarbon is displaced with various alkylene polyamines.

Another class of nitrogen containing dispersants which may be used are those containing Mannich base or Mannich condensation products as they are known in the art. Such Mannich condensation products generally are prepared by condensing about 1 mole of an alkyl substituted phenol with about 1 to 2.5 moles of formaldehyde and about 0.5 to 2 moles polyalkylene polyamine as disclosed, e.g. in U.S. Pat. No. 3,442,808. Such Mannich condensation products may include a long chain, high molecular weight hydrocarbon on the phenol group or may be reacted with a compound containing such a hydrocarbon, e.g. alkenyl succinic anhydride as shown in said aforementioned 3,442,808 patent.

Monocarboxylic acid dispersants have been described in U.K. Patent Specification No. 983,040. Here, the high molecular weight monocarboxylic acid can be derived from a polyolefin, such as polyisobutylene, by oxidation with nitric acid or oxygen; or by addition of halogen to the polyolefin followed by hydrolyzing and oxidation. Another method is taught in Belgian Pat. No. 658,236 where polyolefins, such as polymers of $C_2$ to $C_5$ monoolefin, e.g. polypropylene or polyisobutylene, are halogenated, e.g. chlorinated, and then condensed with an alpha-beta-unsaturated monocarboxylic acid of from 3 to 8, preferably 3 to 4, carbon atoms, e.g. acrylic acid, alpha-methyl-acrylic acid, etc. Esters of such acids, e.g. ethyl methacrylate, may be employed, if desired, in place of the free acid.

Alternatively the ashless dispersants may be esters derived from any of the aforesaid long chain hydrocarbon substituted carboxylic acids and from hydroxy compounds, such as monohydric and polyhydric alcohols, or aromatic compounds such as phenols and naphthols etc. The polyhydric alcohols are the most preferred hydroxy compound and preferably contain from 2 to about 10 hydroxy radicals, for example, ethylene glycol, diethylene glycol, triethylene glycol, tetraethylene glycol, dipropylene glycol, and other alkylene glycols in which the alkylene radical contains from 2 to about 8 carbon atoms. Other useful polyhydric alcohols include glycerol, mono-oleate of glycerol, monostearate of glycerol, monomethyl ester of glycerol, pentaerythritol.

Ester dispersants may also be derived from unsaturated alcohols such as allyl alcohol, cinnamyl alcohol, propargyl alcohol, and oleyl alcohol. Other classes of the alcohols capable of forming useful ester dispersants comprise the ether-alcohols and amino-alcohols including, for example, the oxy-alkylene, oxy-arylene-, amino-alkylene-, and aminoarylene-substituted alcohols having one or more oxy-alkylene, amino-alkylene or amino-arylene oxy-arylene radicals. They are exemplified by Cellosolve, Carbitol, N,N,N',N'-tetrahydroxytrimethylene di-amine, and the like. For the most part, such ether-alcohols having up to about 150 oxy-alkylene radicals in which the alkylene radical contains from 1 to about 8 carbon atoms are preferred. Dispersants may also be prepared from mixtures of polyoxyalkylene polyamines and polyamines or polyoxyalkylene alcohols, polyamines and/or polyols as disclosed in U.S. Pat. Nos. 3,804,763; 3,836,449; 3,836,470; 38346,473 and 3,838,050.

Such ester dispersants may be di-esters of succinic acids or acidic esters, i.e., partially esterified succinic acids; as well as partially esterified polyhydric alcohols or phenols, i.e. esters having free alcohols or phenolic hydroxyl radicals. Mixtures of the above illustrated esters likewise are contemplated within the scope of this invention.

The ester dispersant may be prepared by one of several known methods as illustrated for example in U.S. Pat. No. 3,522,179.

Hydroxyamines which can be reacted with any of the aforesaid long chain hydrocarbon substituted carboxylic acids to form useful lubricating oil dispersants include 2-amino-1-butanol, 2-amino-2-methyl-1-propanol, p-(beta-hydroxyethyl)-aniline, 2-amino-1-propanol, 3-amino-1-propanol, 2-amino-2-methyl-1,3-propane-diol, 2-amino-2-ethyl-1,3-propanediol, tris(hydroxymethyl) aminomethane, 2amino-1-butanol, ethanolamine, and the like. Mixtures of these or similar amines can also be employed. A preferred category here are lactone oxazoline dispersants as disclosed in U.S. Pat. No. 4,062,786 such as the product of tris(hydroxymethyl)aminomethane with a lactonized polyisobutenyl succinic anhydride.

The alkenyl succinic polyamine type dispersants can be further modified with a boron compound such as boron oxide, boron halides, boron acids and ester of boron acids in an amount to provide about 0.1 to about 10 atomic proportions of boron per mole of the acylated nitrogen compound as generally taught in U.S. Pat. Nos. 3,087,936 and 3,254,025. Mixtures of dispersants can also be used such as those described in U.S. Pat. No. 4,113,639.

Also suitable are the multi-functional dispersants which are additives providing the combined effect of dispersancy and viscosity modification. Their dispersant potency may also be improved using the polyisobutenyl succinic anhydride in accordance with this invention.

Examples of these suitable multi-functional viscosity index improvers-dispersants include:

(a) polymers comprised of $C_4$ to $C_{24}$ unsaturated esters of vinyl alcohol or $C_3$ to $C_{10}$ unsaturated mono- or di-carboxylic acid with unsaturated nitrogen containing monomers having 4 to 20 carbons;

(b) polymers of $C_2$ to $C_{20}$ olefins with unsaturated $C_3$ to $C_{10}$ mono- or di-carboxylic acid neutralized with amine, hydroxy amine or alcohols;

(c) polymers of ethylene with a $C_3$ to $C_{20}$ olefin further reacted either by grafting $C_4$ to $C_{20}$ unsaturated nitrogen containing monomers thereon or by grafting an unsaturated acid onto the polymer backbone and then reacting said carboxylic acid groups with amine, hydroxy amine or alcohol.

In these polymers the amine, hydroxy amine or alcohol may be those as described above in relation to the ashless dispersant compounds.

Viscosity index improver-dispersant have a number average molecular weight range as by vapor phase osmometry, membrane osmometry, or gel permeation chromatography, of 1,000 to 2,000,000; preferably 5,000 to 250,000 and most preferably 10,000 to 200,000. It is also preferred that the polymers of group (a) comprise a major weight amount of unsaturated ester and a minor, e.g. 0.1 to 40, preferably 1 to 20 wt percent of a nitrogen containing unsaturated monomer, said weight percent based on total polymer. Preferably the polymer group (b) comprises 0.1 to 10 moles of olefin, preferably 0.2 to 5 moles $C_2$–$C_{20}$ aliphatic or aromatic olefin moieties per mole of unsaturated carboxylic acid moiety and that from 50 percent to 100 percent, of the acid moieties are neutralized. Preferably the polymer of group (c) comprises an ethylene copolymer of 25 to 80 wt percent ethylene with 75 to 20 wt percent $C_3$ to $C_{20}$ mono and/or diolefin, 100 parts by weight of ethylene copolymer being grafted with either 0.1 to 40, preferably 1 to 20 parts by weight unsaturated nitrogen containing monomer, or being grafted with 0.01 to 5 parts by weight of unsaturated $C_3$ to $C_{10}$ mono or dicarboxylic acid, which acid is 50 percent or more neutralized.

The unsaturated carboxylic acids used in (a), (b) and (c) above will preferably contain 3 to 10 more usually 3 or 4 carbon atoms and may be mono carboxylic such as methacrylic and acrylic acids or dicarboxylic such as maleic acid, maleic anhydride, fumaric acid, etc.

Examples of unsaturated esters that may be used include aliphatic saturated mono alcohols of at least 1 carbon atom and preferably of from 12 to 20 carbon atoms such as decyl acrylate, lauryl acrylate, stearyl acrylate, eicosanyl acrylate, docosanyl acrylate, decyl methacrylate, diamyl fumarate, lauryl methacrylate, cetyl methacrylate, stearyl methacrylate, and the like and mixtures thereof.

Other esters include the vinyl alcohol esters of $C_2$ to $C_{22}$ fatty or mono carboxylic acids, preferably saturated, such as vinyl acetate, vinyl laurate, vinyl palmitate, vinyl stearate, vinyl oleate, and the like and mixtures thereof.

Examples of suitable unsaturated nitrogen containing monomers containing 4 to 20 carbon atoms which can be used in (a) and (c) above include the amino substituted olefins such as p-(beta-diethylaminoethyl) styrene; basic nitrogen-containing heterocycles carrying a polymerizable ethylenically unsaturated substituent, e.g. the vinyl pyridines and the vinyl alkyl pyridines such as 2-vinyl-5-ethyl pyridine; 2-methyl-5-vinyl pyridine, 2-vinly-pyridine, 3-vinyl-pyridine, 4-vinyl-pyridine, 3-methyl-5-vinyl-pyridine, 4-methyl-2-vinyl-pyridine, 4-ethyl-2-vinyl-pyridine and 2-butyl-5-vinyl-pyridine and the like.

N-vinyl lactams are also suitable, and particularly when they are N-vinyl pyrrolidones or N-vinyl piperidones. The vinyl radical preferably is unsubstituted ($CH_2{=}CH{-}$), but it may be mono-substituted with an aliphatic hydrocarbon group of 1 to 2 carbon atoms, such as methyl or ethyl.

The vinyl pyrrolidones are the preferred class of N-vinyl lactams and are exemplified by N-vinyl pyrrolidone, N-(1-methylvinyl) pyrrolidone, N-vinyl-5-methyl pyrrolidone, N-vinyl-3,3-dimethyl pyrrolidone, N-vinyl-5-ethyl pyrrolidone, N-vinyl-4-butyl pyrrolidone N-ethyl-3-vinyl pyrrolidone. N-butyl-5-vinyl pyrrolidone and 5-cyclohexyl-N-vinyl pyrrolidone.

Examples of olefins which could be used to prepare the copolymers of (b) and (c) above include mono-olefins such as propylene, 1-butene, 1-pentene, 1-hexene, 1-heptene, 1-decene, 1-dodecene, styrene, etc.

Representative non-limiting examples of diolefins that can be used in (c) include 1,4-hexadiene, 1,5-heptadiene, 1,6-octadiene, 5-methyl-1-4-hexadiene,1,4-cyclohexadiene, 1,5-cyclo-octadiene, vinyl-cyclohexane, dicyclopentenyl and 4,4'-dicyclohexenyl such as tetrahydroindene, methyl tetrahydroindene, dicyclopentadiene, dicyclo(2,2,1)hepta-2,5-dienes, 5-methylene-2-norbornene and 5-ethylidene-2-norbornene.

The metal detegent additives suitable in the diesel oil formulations of the present invention are known in the art and include one or more members selected from the group consisting of overbased oil-soluble calcium, magnesium and barium phenates, sulfurized phenates, and sulfonates, especially the sulfonates of $C_{16}$–$C_{50}$ alkyl substituted benzene or toluene sulfonic acids which have a total base number of about 80 to 300. These overbased materials may be used as the sole metal detergent additive or in combination with the same additives in the neutral form but the overall metal detergent additive combination should have a basicity as represented by the foregoing total base number. Preferably they are present in amounts of from about 3 to 6 wt% with a mixture of overbased magnesium sulfurized phenate and neutral calcium sulfurized phenate, obtained from $C_9$ or $C_{12}$ alkyl phenols being especially useful.

The anti-wear additives useful are the oil-soluble zinc dihydrocarbyldithiophosphate having a total of at least 5 carbon atoms, the alkyl group being preferably $C_5$–$C_8$, typically used in amounts of about 1–6% by weight.

Suitable conventional viscosity index improvers, or viscosity modifiers, are the olefin polymers such as polybutene, ethylene-propylene copolymers, hydrogenated polymers and copolymers and terpolymers of styrene with isoprene and/or butadiene, polymers of alkyl acrylates or alkyl methacrylates and the like. These are used as required to provide the viscosity range desired in the finished oil, in accordance with known formulating techniques.

Examples of suitable oxidation inhibitors are hindered phenols, such as 2,6-ditertiary-butyl-paracresol, amines, sulfurized phenols and alkyl phenothiazines; usually a lubricating oil will contain about 0.01 to 3 weight percent of oxidation inhibitor depending on its effectiveness.

Rust inhibitors are employed in very small proportions such as about 0.1 to 1 weight percent.

Antifoam agents are typically the polysiloxanes present in amounts of about 0.01 to 1 weight percent.

While a wide variety of lubricating oil base stocks may be used in preparing the composition of this invention, most typically mineral oils having a viscosity of about 2–40 centistokes (ASTM-D-445) at 99° C. are employed.

The invention is further illustrated by the following examples which are not to be considered as limitative of its scope. Percentages are by weight except where otherwise indicated.

EXAMPLES

Diesel oil formulations were prepared from solution concentrates prepared by first blending dispersant, metal detergent additive, and zinc antiwear additive, at 65° C. to form a homogeneous solution to which was added polyisobutenyl succinic anhydride prior to diluting the concentrate to provide the finished lubricating oil.

Lubricating oil formulations of this invention were evaluated in the Panel Coker Test, the Sludge Inhibition Bend Test (SIB) and the Varnish Inhibition Bend Test (VIB). The Panel Coker Test is indicative of the performance of a lubricant in a diesel engine while the SIB and VIB tests forecast the performance of a lubricant in a gasoline engine. These three tests are described below:

The SIB Test employs a used crankcase mineral lubricating oil composition having an original viscosity of about 325 SUS at 37.8° C. that have been used in a taxicab that was driven generally for short trips only, thereby causing a buildup of a high concentration of sludge precursors. The oil that was used contained only a refined base mineral oil, a viscosity index improver, a pour point depressant and zinc dialkyldithiophosphate anti-wear additive. The oil contained no sludge dispersants. The quantity of such used oil was acquired by draining and refilling the taxicab crankcase at about 1600–3200 kilometers intervals.

The SIB Test is conducted in the following manner: The used crankcase oil is freed of sludge by centrifuging for one half hour at about 39,000 gravities (gs). The resulting clear bright red oil is then decanted from the insoluble sludge particles thereby separated out. However, the supernatant oil still contains oil-soluble sludge precursors which under the conditions employed by this test will tend to form additional oil-insoluble deposits of sludge. The sludge inhibiting properties of the additives being tested are determined by adding to portions of the used oil a small amount of the particular additive being tested. Ten grams of each one being tested is placed in a stainless steel centrifuge tube and is heated at 140° C. for 16 hours at the presence of air. Following the heating, the tube containing the oil being tested is cooled and then centrifuged for 30 minutes at about 39,000 gs. Any deposits of new sludge that forms in this step are separated from the oil by decanting supernatant oil and then carefully washing the sludge deposits with 15 ml. of pentane to remove all remaining oils from the sludge. The weight of the new solid sludge that formed in the test, in milligrams, is determined by drying the residue and weighing it. The results are reported as milligrams of sludge per ten grams of oil, thus measuring differences as small as one part per ten thousand. The less new sludge formed, the more effective is the additive as a dispersant. In other words, if the additive is effective, it will hold at least a portion of the new sludge that forms on heating and oxidation, stably suspended in the oil so that it does not precipitate down during the centrifuging period.

In the VIB Test, a test sample consisting of ten grams of lubricating oil containing the additive being evaluated is used. The test oil is a commercial lubricating oil obtained from a taxi after 3200 kilometers of driving with said lubricating oil. Each sample is heat soaked overnight at about 140° C. and thereafter centrifuged to remove the sludge. The supernatant fluid of each sample is subjected to heat cycling from about 150° C. to room temperature over a period of 3.5 hours at a frequency of about two cycles per minute. During the heating phase, a gas containing a mixture of 0.7 volume percent $SO_2$, 1.4 volume percent NO and the balance air was bubbled through the test samples and during the cooling phase, water vapor was bubbled through the test samples. At the end of the test period, which testing cycle can be repeated as necessary to determine the inhibiting effect of any additive, the wall surfaces of the test flasks in which the samples were contained are visually evaluated as to the varnish inhibition. The amount of varnish deposited on the walls is rated at values of from one to seven with the higher number being the greater amount of varnish. It has been found that this test forecasts the varnish results obtained as a consequence of carrying out the ASTM MS-VD engine tests.

The Panel Coker Test is described in MIL-L-7808C specification and measures the deposit-forming properties of an oil. The oil is heated to 338° C. and sprayed onto a stainless steel panel held at 371° C. and then recirculated. The test duration is 60 minutes. The test measures the amount of deposits retained by the panel. The Panel Coker Test is widely recognized as an indication of the performance of a lubricating oil in a diesel engine. In Test Condition 1, a temperature greater than 338° C. is used; in Test Condition 2, a temperature of 330° C. is used and Test Condition 3, the temperature is maintained at 338° C. Temperature conditions of 338° C. and above are considered important in terms of forecasting performance of an oil in a diesel engine.

EXAMPLES

The five lubricating Oil Test Formulations detailed below were evaluated for gasoline engine performance in the SIB/VIB Tests and for diesel engine performance in the Panel Coker Tests.

Test Formulations, weight percent

| Component | No. 1 | No. 2 | No. 3 | No. 4 | No. 5 |
|---|---|---|---|---|---|
| Dispersant | 3.0 | 3.0 | 3.0 | 3.0 | 3.0 |
| PIBSA | 3.0 | 3.0 | 3.0 | 3.0 | 3.0 |
| Detergent | 2.0 | 2.0 | 2.0 | 2.0 | 3.0 |
| Antiwear | 1.0 | 1.0 | 1.0 | 1.0 | 1.0 |
| Base Oil | 91.0 | 91.0 | 91.0 | 91.0 | 90.0 |

In Test Formulations 1 and 3 the dispersant was a polyisobutenyl succinic anhydride-polyamine reaction product; in Test Formulations 2 and 4, the dispersant was a borated polyisobutenyl ($\overline{M}n=900$) succinic anhydride-polyamine reaction product and in Test Formulation 5, the dispersant was a borated polyisobutenyl ($\overline{M}n=1300$) succinic anhydride-polyamine reaction product. Dispersant was used as a 50% active solution in Base Oil.

In all Formulations, PIBSA refers to a polyisobutenyl succinic anhydride of $\overline{M}n=1300$ and saponification No. of 103.

The detergent in Formulations 1 and 2 was an overbased metal sulfonate, in 3 and 4 it was an overbased sulfurized phenate and in Formulation 5 it was an overbased mixture of metal phenates.

The anti-wear additive in all Formulations was a zinc dialkyl dithiophosphate.

The Base Oil in all Formulations was a mixture of paraffinic mineral oils of kinematic viscosity 31 (20%) and 127.5 cs min. (80%) at 37.8° C.

These Formulations were evaluated with both PIBSA and dispersant present as well as with either material present alone in the absence of the other. These comparative evaluations demonstrate the unusual effect attributable to the presence of both in the lubricating oil. When PIBSA or dispersant was not present, additional Base Oil was used to replace these materials.

TABLE I

COMPARATIVE SIB/VIB EVALUATIONS

| Formulation | PIBSA Present | Dispersant Present | SIB Rating | Δ SIB No Disp | % Δ SIB | VIB Rating | Δ VIB No Disp | % Δ VIB |
|---|---|---|---|---|---|---|---|---|
| 1 | Yes | No | 8.44 | | | 11 | | |
| | No | Yes | 6.82 | 1.62 | 19 | 9 | 2 | 18 |
| | Yes | Yes | 7.04 | | | 8 | | |
| 2 | Yes | No | 8.44 | | | 11 | | |
| | No | Yes | 7.32 | 1.23 | 13 | 10 | 1 | 9 |
| | Yes | Yes | 6.70 | | | 10 | | |
| 3 | Yes | No | 7.15 | | | 11 | | |
| | No | Yes | 4.60 | 2.55 | 36 | 7.5 | 3.5 | 32 |
| | Yes | Yes | 4.08 | | | 7 | | |
| 4 | Yes | No | 6.03 | | | 11 | | |
| | No | Yes | 4.97 | 1.05 | 18 | 10 | 1 | 9 |
| | Yes | Yes | 4.30 | | | 9 | | |
| Average | | | | 1.61 | 21.5 | | 1.9 | 17 |

The data in Table I shows that oils formulated without a conventional lubricating oil dispersant, but containing polyisobutenyl succinic anhydride, do not provide satisfactory SIB/VIB ratings and such oils would not be expected to qualify under current standards so as to be commercially suitable crankcase lubricants in gasoline engines. Oils containing both PIBSA and dispersant exhibit acceptable SIB/VIB ratings.

For example, in Formulation 1, when PIBSA alone was present, both the SIB and VIB ratings are unacceptably high. When dispersant alone is present, the ΔSIB (change in SIB) is 1.62 and the % change is 19. Similarly, when dispersant alone is present, the ΔVIB is 2 and the % ΔVIB is 18. When both PIBSA and dispersant are present, the Formulation retains the SIB and VIB ratings which are considered acceptable. Similar results were obtained for the other Test Formulations.

The data in Table II are presented to show the effect on Panel Coker attributable to PIBSA alone in the absence of conventional dispersant. Thus, insofar as performance of the oil in diesel engines is concerned, the Panel Coker data, which is viewed by the industry as a significant indicator of diesel performance, shows a beneficial effect from the PIBSA. However, Table I clearly shows the PIBSA alone will not provide an oil with satisfactory performance in a gasoline engine.

TABLE II

IMPROVEMENT IN PANEL COKER RATING ON REPLACEMENT OF DISPERSANT BY PIBSA

| Formulation | Test Condition | Dispersant Present | PIBSA Present | Panel Coker Rating | Δ P.C.R. | Improvement P.C.R. |
|---|---|---|---|---|---|---|
| 1 | 1 | Yes | No | 81.8 | | |
| | | No | Yes | 24.5 | 57.3 | 70 |
| 1 | 2 | Yes | No | 4.7 | | |
| | | No | Yes | 0.7 | 4.0 | 85 |
| 1 | 3 | Yes | No | 10.0 | | |
| | | No | Yes | 5.2 | 4.8 | 48 |
| 2 | 3 | Yes | No | 14.2 | | |
| | | No | Yes | 7.25 | 6.95 | 49 |
| 2 | 3 | Yes | No | 2.5 | | |
| | | No | Yes | 5.2 | −2.7 | −108 |
| 3 | 3 | Yes | No | 87.0 | | |
| | | No | Yes | 56.8 | 30.2 | 35 |
| 3 | 3 | Yes | No | 85.1 | | |
| | | No | Yes | 38.7 | 46.4 | 54 |
| 4 | 3 | Yes | No | 39.3 | | |
| | | No | Yes | 41.8 | −2.5 | −6 |
| 4 | 3 | Yes | No | 31.7 | | |
| | | No | Yes | 38.7 | −7.0 | −22 |
| 5 | 3 | Yes | No | 13.9 | | |
| | | No | Yes | 15.2 | −1.3 | −9 |
| 5 | 3 | Yes | No | 6.3 | | |
| | | No | Yes | 9.2 | −2.9 | −46 |
| | | | TOTAL | | +133.25 | 250% |

Table III, set forth below, reports the Panel Coker ratings for oils containing both dispersant and PIBSA and it shows that the oil retains its excellent Panel Coker ratings when the dispersant-PIBSA combination is used. Thus, the oil formulated with the combination of PIBSA and dispersant in accordance with this invention exhibits both gasoline and diesel engine performance enabling a crankcase lubricant to be formulated which can qualify for use in both categories of engines and this is a significant achievement in lubricating oil additive technology.

TABLE III

IMPROVEMENT IN PANEL COKER RATING ON ADDING PIBSA TO A DISPERSANT FORMULATION

| Formulation | Test Condition | Dispersant Alone | Dispersant + PIBSA | Panel Coker Rating | Δ P.C.R. | % Δ P.C.R. |
|---|---|---|---|---|---|---|
| 1 | 1 | Yes | No | 81.8 | | |
| | | No | Yes | 28.1 | 53.7 | 66 |
| | 2 | Yes | No | 4.7 | | |
| | | No | Yes | 2.9 | 1.8 | 38 |

TABLE III-continued

IMPROVEMENT IN PANEL COKER RATING ON ADDING PIBSA TO A DISPERSANT FORMULATION

| Formulation | Test Condition | Dispersant Alone | Dispersant + PIBSA | Panel Coker Rating | Δ P.C.R. | % Δ P.C.R. |
|---|---|---|---|---|---|---|
| | 3 | Yes | No | 10.0 | | |
| | | No | Yes | 6.7 | 3.3 | 33 |
| 2 | 3 | Yes | No | 14.2 | | |
| | | No | Yes | 10.4 | 3.8 | 36 |
| | 3 | Yes | No | 2.5 | | |
| | | No | Yes | 3.6 | −1.1 | −44 |
| 3 | 3 | Yes | No | 87.0 | | |
| | | No | Yes | 64.9 | 22.1 | 25 |
| | 3 | Yes | No | 85.1 | | |
| | | No | Yes | 47.1 | 38.0 | 45 |
| 4 | 3 | Yes | No | 39.3 | | |
| | | No | Yes | 33.9 | 5.4 | 14 |
| | 3 | Yes | No | 31.7 | | |
| | | No | Yes | 18.1 | 13.6 | 43 |
| 5 | 3 | Yes | No | 13.9 | | |
| | | No | Yes | 9.6 | 4.0 | 29 |
| | 3 | Yes | No | 6.3 | | |
| | | No | Yes | 10.0 | −3.7 | −59 |
| | | | | TOTAL | 140.9 | 226% |

Additional formulations were prepared with oil containing other types of dispersants than were used in the foregoing examples and these were evaluated when formulated with polyisobutenyl succinic anhydride (Mn=1300). Each formulation contained conventional amounts of metal detergent additives, anti-oxidant, and anti-wear additives in addition to the dispersant-polyisobutenyl succinic anhydride hydride combination. These Panel Coker data demonstrated that the improvements obtained by use of polyisobutenyl succinic anhydride applies to lubricating oil dispersants generally. Results are tabulated below:

| Formulation | Dispersant Type, wt % | | PIBSA, wt % | Deposits, mg. |
|---|---|---|---|---|
| 1 | Borated Polyamine, | 0.9 | 1.8 | 81.0 |
| 2 | Oxazoline, | 0.9 | 1.8 | 77.2 |
| 3 | Lactone Oxazoline, | 0.9 | 1.8 | 53.2 |
| 4 | Polyol | 0.9 | 1.8 | 43.1 |
| 5 | Polyamine Polyol | 0.9 | 1.8 | 61.3 |
| 6 | Mannich Base | 0.9 | 1.8 | 91.0 |
| 7 | VI-Dispersant, | 0.9 | 1.8 | 67.0 |
| 8 | Borated Polyamine, | 2.5 | 1.8 | 62.9 |
| 9 | Oxazoline | 2.5 | 1.8 | 62.5 |
| 10 | Lactone Oxazoline | 2.5 | 1.8 | 63.6 |
| 11 | Polyol | 2.5 | 1.8 | 65.2 |
| 12 | Polyamine Polyol | 2.5 | 1.8 | 54.7 |
| 13 | Mannich Base | 2.5 | 1.8 | 77.0 |
| 14 | VI-Dispersant | 2.5 | 1.8 | 51.2 |

"PIBSA" is polyisobutenyl succinic anhydride ($\overline{M}n$ = 1300).

Formulations 1 and 8 contain the same borated polyisobutenyl succinimide dispersant used in the foregoing examples. The other dispersant types are described below:

Oxazoline:

Reaction product of polyisobutenyl succinic anhydride and tris-hydroxymethyl-amino methane.

Lactone Oxazoline:

Reaction product of a lactonized polyisobutenyl succinic anhydride and tris-hydroxymethyl aminomethane.

Polyol:

Ester-type dispersant formed by reacting a polyhydric alcohol with a polyisobutenyl succinic anhydride.

Polyol Polyamine:

Reaction product of a polyisobutenyl succinic anhydride with both an alkylene polyamine and a polyhydric alcohol.

Mannich Base:

Reaction product of alkylated phenol with formaldehyde and alkyelene polyamine.

VI-Dispersant

A multifunctional dispersant viscosity index improver being an ethylene-propylene copolymer grafted with maleic anhydride and subsequently reacted with an alkylene polyamine.

What is claimed is:

1. Crankcase lubricating oil composition effective in both gasoline and diesel internal combustion engines comprising a major amount of an oil of lubricating viscosity containing 0–15 wt. % of a viscosity index improver and (a) at least about 0.5 wt. % of a lubricating oil dispersant;

(b) about 2 to 12 wt. % of an overbased metal detergent additive or mixtures thereof with neutral metal detergent additive, said metal detergent additive being selected from the group consisting of oil soluble calcium, magnesium and barium sulfonates, phenates, and sulfurized phenates;

(c) a zinc dialkyl dithiophosphate anti-wear additive; and (d) a polyisobutenyl succinic anhydride having and $\overline{M}n$ (number average) molecular weight of about 900 to 2000;

wherein the weight ratio of said dispersant to said polyisobutenyl succinic anhydride is less than 1.75 when the amount of dispersant in the composition is about 3.5 wt. % or less and said weight ratio being less than about 7 when the amount of dispersant present is greater than 3.5 wt. % up to about 10 wt. %.

2. The composition of claim 1 wherein the polyisobutenyl succinic anhydride has a $\overline{M}n$ of about 1300.

3. The composition of claim 2 wherein said lubricating oil contains about 2.5 to 5 wt. % of the polyisobutenyl succinic anhydride.

4. The composition of claim 3 wherein the lubricating oil contains about 0.7 to 3 wt. % of the dispersant.

5. The composition of claim 4 wherein the dispersant is a borated polyisobutenyl succinic anhydride-polyalkylene amine reaction product, the polyisobutenyl having a $\overline{M}n$ of about 900 to 2,000.

6. The composition of claim 1 further comprising effective amounts of an antioxidant, anti-rust additive, anti-foamant and friction reducing additive to provide their normal attendant functions.

7. The composition of claim 1 wherein the metal detergent additive is a mixture of overbased magnesium sulfurized phenate and neutral calcium sulfurized phenate present in an amount of about 3 to 6 wt%.

8. The composition of claim 1 wherein there is present about 1–3 wt % of the zinc dialkyldithio-phosphate, the alkyl having 5–8 carbon atoms.

9. The composition of claim 1 wherein the dispersant is a dispersant-viscosity index improver.

* * * * *